US005495883A

United States Patent [19]

Jelic

[11] Patent Number: 5,495,883

[45] Date of Patent: Mar. 5, 1996

[54] WINDOW SHADE CORD SAFETY SHROUD

[75] Inventor: Ralph Jelic, Valencia, Pa.

[73] Assignee: Verosol USA Inc., Pittsburgh, Pa.

[21] Appl. No.: 286,626

[22] Filed: Aug. 5, 1994

[51] Int. Cl.[6] ..... A47H 5/00

[52] U.S. Cl. ..... 160/84.04; 160/178.1

[58] Field of Search ..... 160/84.01, 84.02, 160/84.03, 84.04, 84.05, 84.06, 84.07, 168.1 R, 173 R, 178.1 R, 344, 345, 348

[56] References Cited

U.S. PATENT DOCUMENTS

| | | | |
|---|---|---|---|
| 978,220 | 12/1910 | Sarkisian | 160/84.01 |
| 2,083,881 | 6/1937 | Wade | 160/173 R |
| 2,159,734 | 5/1939 | French | 160/344 |
| 2,302,630 | 11/1942 | Hess | 160/348 |
| 2,410,549 | 11/1946 | Olson | 160/168.1 R |
| 2,779,405 | 1/1957 | Hess | 160/348 |
| 3,485,285 | 12/1969 | Anderle | 160/168 |
| 3,633,646 | 1/1972 | Zilver | 160/168.1 R |
| 3,952,788 | 4/1976 | Scholer | 160/84.01 |
| 4,765,388 | 8/1988 | Dohlemann | 160/84.01 |
| 4,777,673 | 10/1988 | Patteson et al. | 160/84.01 X |
| 4,909,298 | 3/1990 | Lanhart et al. | 160/178.1 |
| 4,974,656 | 12/1990 | Judkins | 160/84.04 |

*Primary Examiner*—David M. Purol

*Attorney, Agent, or Firm*—Buchanan Ingersoll; Lynn J. Alstadt

[57] ABSTRACT

A cord shroud used in cooperation with a window shade assembly and the like of the type having a bottomrail and a headrail, with a cord lock attached either internal or external to the headrail. The window blind assembly further having at least two lift cords, each of which are connected at one end to the bottomrail, pass through the headrail and cord lock, and have an opposite end that is accessible to an operator. The cord shroud is fashioned of an elongated, flexible ribbon having a first end connected to the headrail and a second end that is accessible to the operator. The cord shroud further has a plurality of apertures disposed along the length of the ribbon, through which the lift cords pass. The ribbon has a length sufficient to fit over substantially all of that portion of the lift cords, which is exposed when the window is open. The apertures may be holes provided through the ribbon or loops or rings attached to the ribbon. The ends of the lift cords accessible to the operator and the end of the ribbon accessible to the operator are connected, preferably by a handle.

15 Claims, 4 Drawing Sheets

Prior
Art

WINDOW SHADE CORD SAFETY SHROUD

BACKGROUND OF THE INVENTION

1. Field of the Invention

This invention relates generally to lift cords used with window shade assemblies, and, more particularly, the invention relates to safety devices used with such window shade lift cords.

2. Description of the Prior Art

Window shade assemblies and venetian blinds typically have window covering material or blind slats extending between a headrail and bottomrail and two or more lift cords connected to the bottom. Within the headrail is some type of cord locking device. Typically, two or more lift cords are connected at one end to the bottomrail and extend up through the window covering material or blind slats into the headrail. The lift cords then pass through a cord locking device and out of the headrail such that an opposite end of the lift cords is accessible to an operator. Two lift cords may be formed from a signal length of cording. This general arrangement can be seen in prior art FIG. 1.

This type of window shades and blinds are typically raised by the operator pulling on the accessible portion of the lift cords and are lowered by releasing the lift cords. Because all lift cords must move in unison, the lift cords are typically tied together or otherwise looped as can be seen in FIG. 1. The lift cords often extend downward from the headrail to within a few feet of floor level.

The lift cords of the window shade assembly present an attractive danger to infants or children who may play with the lift cords. There have been several instances in which children and infants have become entangled in the cords and accidentally hanged.

In the past, attempts to reduce the danger associated with these lift cords have focused on moving the lift cords out of the accessible range of infants such as by tying or clipping the cords to shorten them or otherwise moving the lift cords away from floor level and away from the infants reach. Moving the cords out of the way after use is troublesome, and the operator must remember to move the cords after each use. Other attempts have focused on a detachable connection of the lift cords ends such as is disclosed in U.S. Pat. No. 4,909,298 to Langhart et al. Detachable lift cords require a certain level of force to detach. Moreover, recent tests of the commercially available embodiment of the Langhart patent have shown that this product failed to detach in simulated entanglements. And although window shade assemblies are designed to be aesthetically pleasing, none of the attempts of the prior art to reduce the dangers associated with lift cords are particularly aesthetically pleasing. Thus, there is a need in the industry to reduce the danger associated with lift cords which does not require any separate actions by the operator, in an efficient yet aesthetically pleasing manner.

SUMMARY OF THE INVENTION

I provide a cord shroud as a means for reducing the dangers associated with lift cords of a window shade assembly. Thus, the cord shroud is used in cooperation with a window shade assembly. The window shade assembly is of the type having a bottomrail and a headrail, with a cord lock attached either internal or external to the headrail. The window shade assembly further has at least two lift cords, each of which are connected at one end to the bottomrail, pass through the headrail and cord lock, and have an opposite end that is accessible to an operator. A portion of the lift cords that extends from the headrail to the opposite, accessible ends when the window shade is drawn up toward the headrail in an open position is said to be the exposed portion.

The cord shroud is fashioned of an elongated, flexible ribbon. The ribbon has a first end connected to the headrail and a second end that extends downward from the headrail and is accessible to the operator. The cord shroud further has a plurality of apertures disposed along the length of the ribbon, through which the lift cords pass. The ribbon has a length sufficient to fit over substantially all of the exposed portion of the lift cords.

The ends of the lift cords accessible to the operator and the end of the ribbon accessible to the operator are connected. Thus, pulling the lift cords out of the window shades to lift the window shade simultaneously lengthens the ribbon and the lift cords remain confined within the apertures of the ribbon. It is preferred that the lift cord ends and the ribbon end are connected by means of a handle. The handle is preferably lightweight, such as by being plastic or hollow metal or plastic. The handle is connected to the end of the ribbon by any convenient means. It is preferred that the handle has an opening through which the ends of the lift cord are disposed and therein secured. A single pull cord may extend from the handle such that the pull cords may be activated by pulling the handle or by pulling the pull cord.

By providing the lift cords through the apertures of the ribbon, the lift cords are relatively confined by the shroud and prevented from opening apart and creating a loop or noose. When the window shade is down so that the accessible ends of the lift cords are drawn up towards the headrail, the ribbon has folded up, yet the portions of the lift cords which extend from the headrail remain within the apertures of the ribbon.

The shape, size and type of flexible material of the ribbon, the manner in which the apertures are provided, and the size, shape and positioning of the apertures along the ribbon may also be varied.

In a first preferred embodiment, the ribbon is simply a flat section of material and the apertures are generally transverse slits provided along the length of the ribbon. The ribbon is preferably a laced fabric, but may also be a nonlaced fabric, a plastic, a paper or a combination thereof.

In a second preferred cord shroud, the apertures are provided as a plurality of relatively thin loops, spacedly attached to the ribbon of material, and each aperture is formed by and bounded by a respective loop and the ribbon. In addition, the loops may be shaped and attached to the ribbon in such a manner so as to form two or more apertures. Such multiple apertures may be formed by affixing each loop to the ribbon at more than two points.

In another preferred embodiment of the cord shroud, the ribbon is pleated so as to have a series of transverse pleats provided thereon alternately oriented in opposite directions. Holes are then placed through the pleated material. Also, the pleated ribbon may further be tabbed such that each pleat terminates in a respective tab. In this embodiment, the apertures are preferably provided through the tabs.

Other objects and advantages of the invention will become apparent from a description of certain present preferred embodiments thereof shown in the drawings.

DETAILED DESCRIPTION OF THE PREFERRED EMBODIMENTS

The present invention can be used with any type of window covering which uses lift cords including pleated shades, roman shades and venetian blinds. Although the present preferred embodiments are shown and described in use with pleated shades, the invention is not limited thereto.

Figure 2:
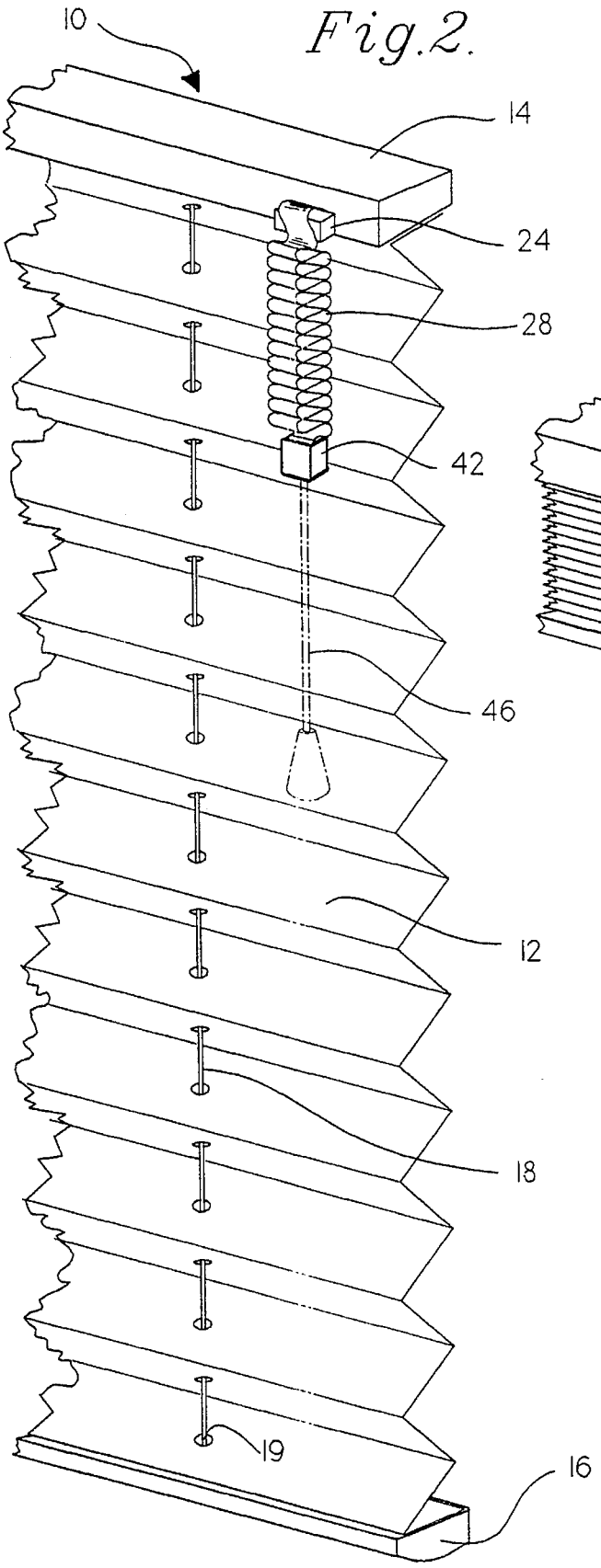
FIG. 2 is a perspective view of the present preferred lift cord shroud cooperating with a window shade assembly in which the window shade has been lowered to a closed position.
Figure 3:
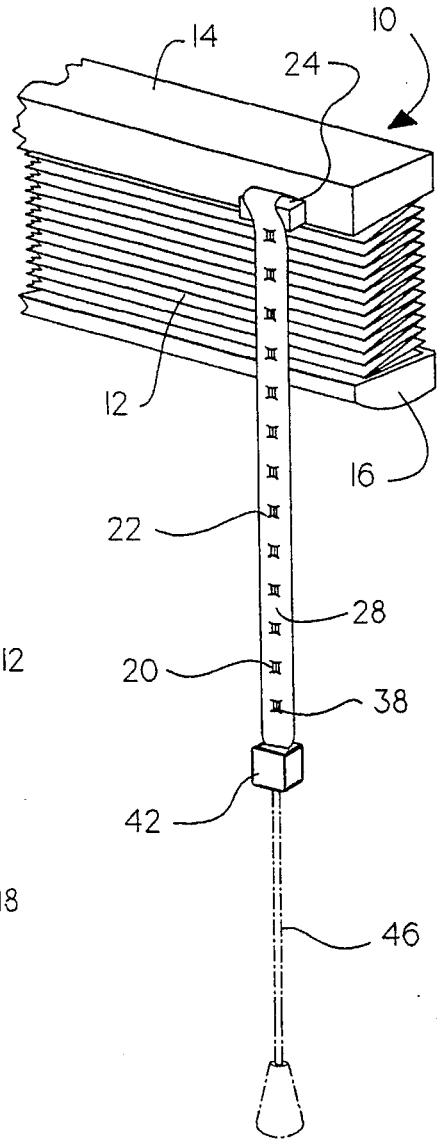
FIG. 3 is a view similar to FIG. 2 in which the window shade has been raised to an open position.

Referring first to FIGS. 2 and 3, the cord shroud 26 is used in cooperation with a window shade assembly 10. The window shade assembly 10 is of the type having a bottomrail 16 and a headrail 14 and a window covering material 12 provided therebetween. The window shade assembly 10 has a cord lock 24 attached either internal or external to the headrail 14. The window shade assembly 10 further has at least two lift cords 18. Each of the lift cords 18 are connected at one end 19 to the bottomrail 16, pass through the headrail 14 and cord lock 24, and have an opposite end 20 that is accessible to an operator. An exposed portion 22 of the lift cords 18 extends from the headrail 14 to the opposite, accessible ends 20 is exposed when the window shade is raised as shown in FIG. 3.

The cord shroud 26 is fashioned of an elongated, flexible ribbon 28. The ribbon 28 has a first end 30 connected to the headrail 14 and a second end 32 that extends downward from the headrail 14 and is accessible to the operator. The cord shroud 26 further has a plurality of apertures 38 disposed along the length of the ribbon 28, through which the lift cords 18 pass. The ribbon 28 has a length sufficient to fit over substantially all of the exposed portion 22 of the lift cords 18.

The ends 20 of the lift cords 18 accessible to the operator and the second end 32 of the ribbon 28 accessible to the operator are connected. Thus, pulling the lift cords 18 out of the window shade 12 to lift the window shade 12 simultaneously lengthens the ribbon 28. Although the lift cord accessible ends 20 and the ribbon second end 32 may be connected by any convenient means, such as by tying them together, it is preferred that the lift cord accessible ends 20 and the ribbon second end 32 are connected by means of a handle 42. If desired, the handle may be the same shape as the bottomrail. The handle 42 is preferably lightweight, such as by being made of plastic or hollow metal or plastic. The handle 42 is connected to the second end 32 of the ribbon 28 by any convenient means. It is preferred that the handle 42 has an opening 44 through which the accessible ends 20 of the lift cord 18 are disposed and therein secured. A single pull cord 46 may extend from the handle 42 such that the lift cords 18 may be activated by pulling the handle 42 or by pulling the pull cord 46. Certain preferred embodiments will be now hereby described in which like reference numerals will be used for like structure. The like reference numerals each have a letter suffix denoting different embodiments.

Figure 4A:
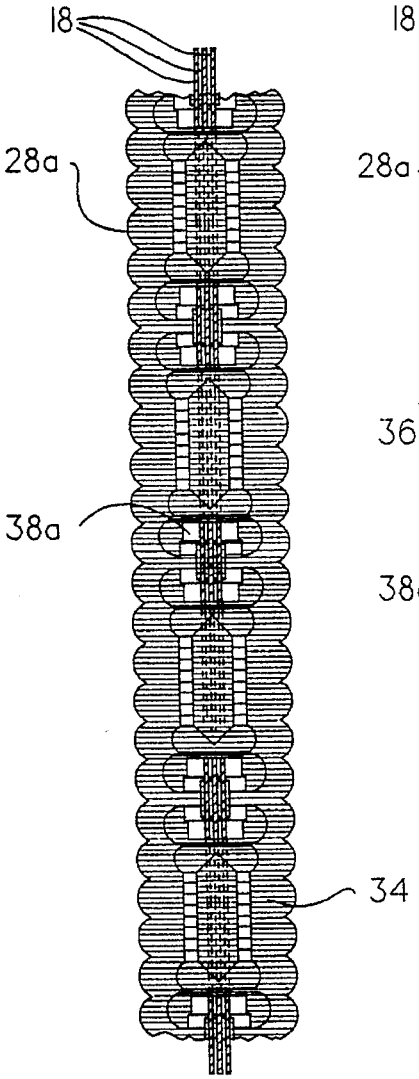
FIG. 4*a* is a front view of a portion of a first preferred lift cord shroud.
Figure 4B:
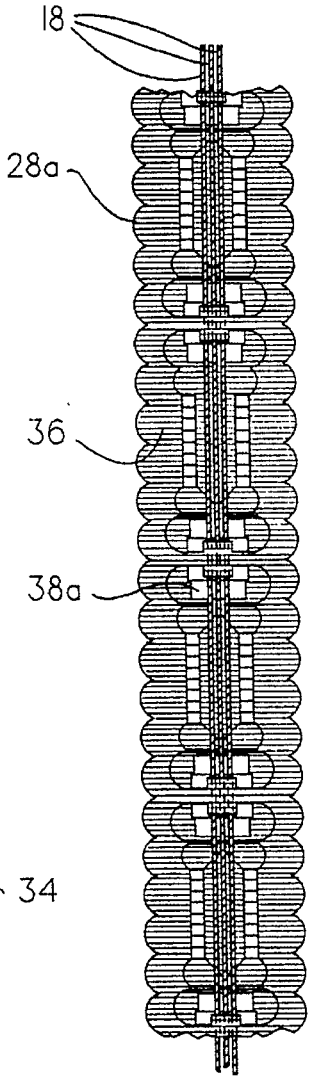
FIG. 4*b* is a rear view of a portion of the first preferred lift cord shroud.
Figure 5:
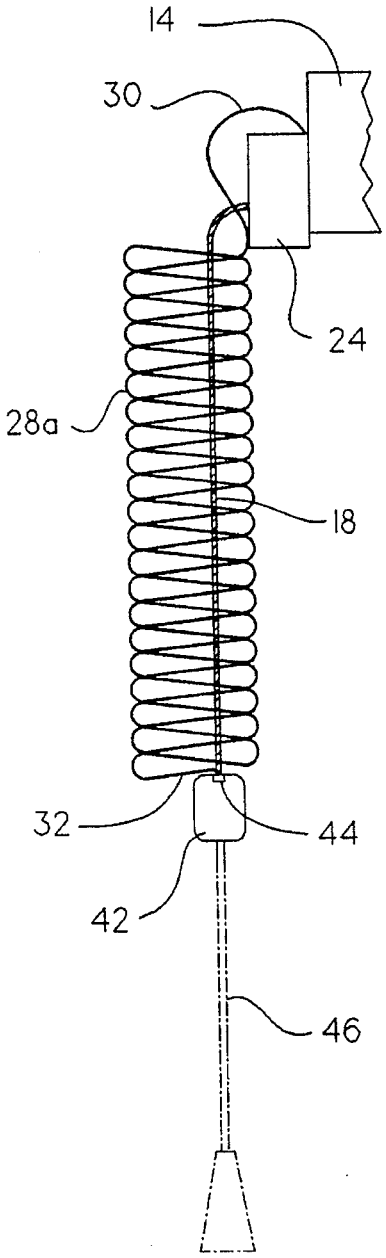
FIG. 5 is a side elevational view of the first preferred lift cord shroud in which the window shade assembly is in the closed position.

A first preferred embodiment is shown in FIGS. 4*a*, 4*b* and 5. In this embodiment, the ribbon 28*a* is simply a flat section of material. However, the shape, size and type of flexible material utilized for the ribbon 28*a* may be varied while remaining within the scope of the present invention and the apertures 38*a* are generally transverse slits provided along the length of the ribbon 28*a*. The ribbon 28*a* is preferably a laced-type fabric, but may also be a nonlaced fabric, a plastic, a paper or a combination thereof. The lift cords 18 enter one aperture 38*a* from a front face 34 of the ribbon 28*a* and then enter the next aperture 38*a* from the rear face 36 of the ribbon 28*a*. In this way, the lift cords 18 are woven through the apertures 38*a*. Consequently, the lift cords 18 are prevented from separating and forming a loop. Whether the shade assembly 10 is in the open position and the ribbon 28*a* is fully extended as shown in FIGS. 4*a* and 4*b*, or the shade assembly 10 is lowered to the closed position and the ribbon 28*a* is folded over as shown in FIG. 5, the lift cords 18 remain restrained by the ribbon 28*a*.

Figure 6:
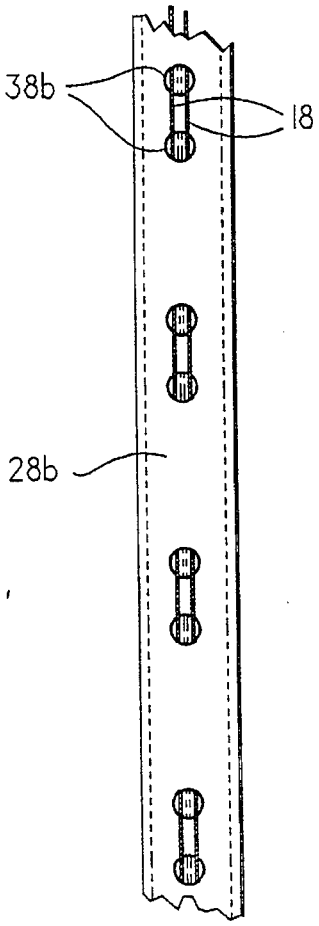
FIG. 6 is a front elevational view of a portion of a next preferred lift cord shroud.

Referring next to FIG. 6, an embodiment similar to the embodiment shown in FIGS. 4*a*, 4*b* and 5 is shown. In this embodiment, the ribbon 28*b* is also a flat section of material. However, in this embodiment, the apertures 38*b* are generally circular holes. Although the circular apertures 38*b* are provided along the length of the ribbon 28*b*, the apertures 38*b* are grouped in pairs. Thus, the size, shape and positioning of the apertures 38*b* along the ribbon 28*b* may also be varied.

Figure 1:
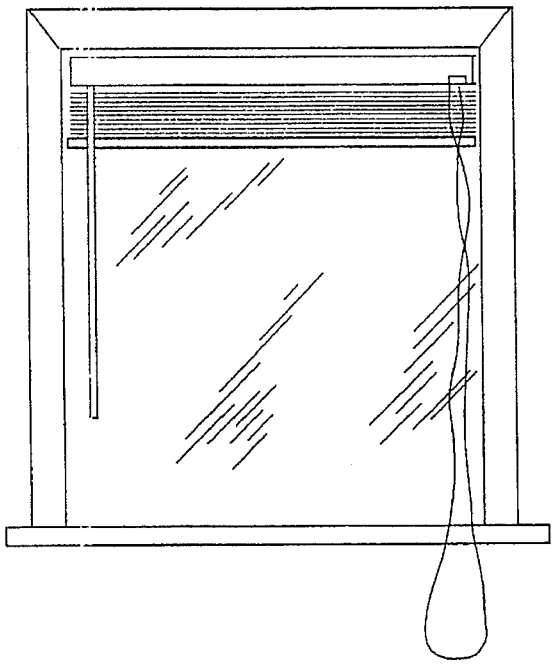
FIG. 1 is a prior art window shade assembly affixed to a window showing looped lift cords.
Figure 7:
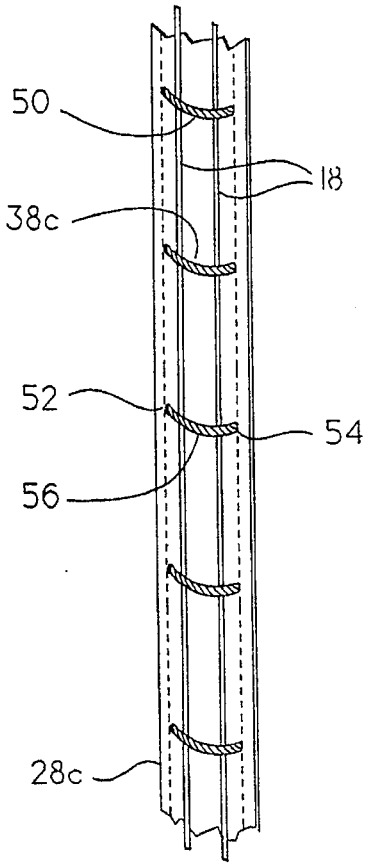
FIG. 7 is a front elevation view of a portion of a next preferred lift cord shroud wherein the apertures are formed by loops.

In another preferred cord shroud shown in FIG. 7, the apertures 38*c* are provided by a plurality of loops 50, spacedly attached to the ribbon 28*c*. The ribbon 28*c* is preferably a flat section of material. It is also preferred that each loop 50 is a relatively thin section of material that is sewn or otherwise attached to the ribbon 28*c* at opposed ends 52, 54 of the loop 50. Thus, lift cords 18 may be provided between the portion 56 of the loops 50 between the opposed loop ends 52, 54 and the ribbon 28*c*. In this embodiment, each aperture 38*c* of the cord shroud is, therefore, formed by and bounded by a respective loop 50. The loops 50 may be formed of any material such as metal, plastic or fabric. Thus, as demonstrated by this embodiment, the providing of apertures 38*c* along the ribbon 28*c* may be accomplished by various means.

Figure 8:
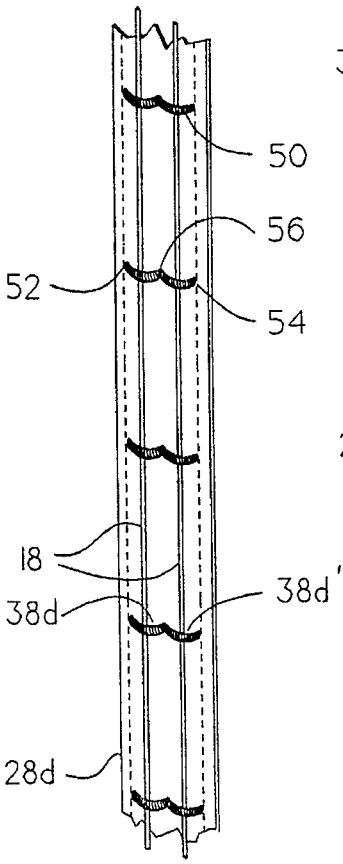
FIG. 8 is a view similar to FIG. 7 wherein the loops are attached to form two apertures.

In addition, the loops 50 may be shaped and attached to the ribbon 28*d* in such a manner so as to form two or more apertures 38*d*, as is shown in FIG. 8. In this embodiment, the cords cannot be twisted or wrapped around one another. One such way to form two or more apertures 38*d* from each loop 50 is to sew or otherwise affix the loop 50 to the ribbon 28*d* at the intermediate loop portion 56. For example, if the loop 50 is attached to the ribbon 28*d* at one location along the loop intermediate portion 56 between the opposed loop ends 52, 54, two apertures 38*d* are formed. One aperture 38*d* between the loop intermediate portion 56 and front loop end 52, and a second aperture 38*d*' between the loop intermediate portion 56 and the opposite loop end 54.

Figure 9:
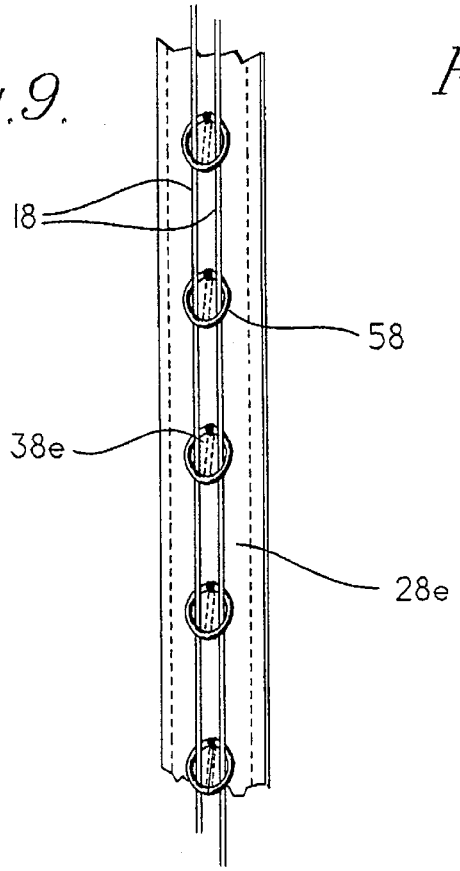
FIG. 9 is a front elevational view of a portion of a next preferred embodiment wherein the apertures are formed by rings.

In yet another preferred embodiment shown in FIG. 9, the ribbon 28*e* is again a flat section of material. The apertures 38*e* are provided by a plurality of rings 58, spacedly attached to the ribbon 28*e*. Preferably, each ring 58 is a relatively thin, lightweight section of material sewn or otherwise attached to the ribbon 28*e*. Thus, the lift cords 18 may be provided through each ring 58. In this embodiment, the ring 58 itself forms and bounds each respective aperture 38*e*. The rings 58 may be shaped and attached to the ribbon 28*e* in such a manner so as to form two or more apertures 38*e*. Two or more rings may be provided side by side along the length of the ribbon 28*e*, so that two or more sets of apertures are provided along the length of the ribbon 28*e*.

Figure 10:
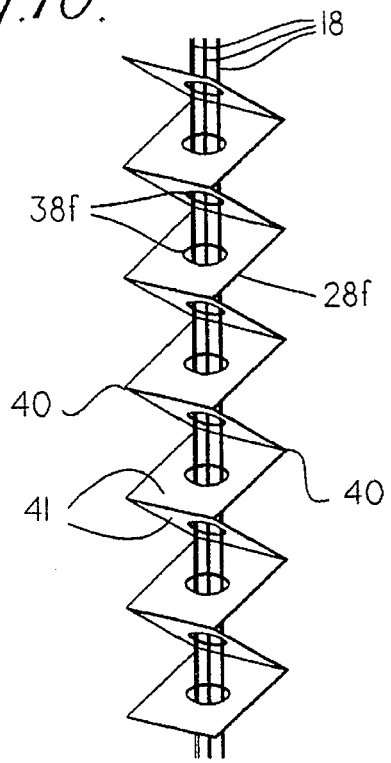
FIG. 10 is a perspective view of a portion of a next preferred cord shroud having a pleated ribbon.

In another preferred embodiment of the cord shroud shown in FIG. 10, the ribbon 28*f* is folded or creased so as to have a series of transverse pleats 40 provided thereon alternate in opposite directions. Each pleat has a pair of adjacent material sections 41. The apertures 38*f* are then provided through each pleat section 41. The pleated material of the ribbon 28*f* may be made of any suitable material, such as fabric, plastic or paper.

Figure 11:
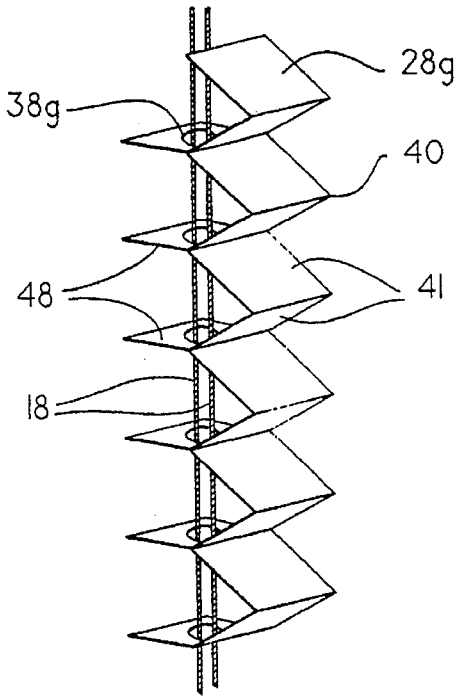
FIG. 11 is a perspective view of a portion of the front of a next preferred cord shroud having a tabbed and pleated ribbon.
Figure 12:
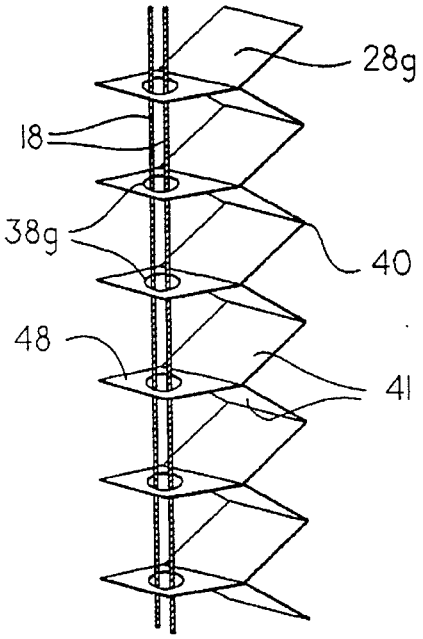
FIG. 12 is a perspective view of a portion of the rear of the cord shroud of FIG. 11.

As a further alternative of the cord shroud shown in FIGS. 11 and 12, the pleated ribbon 28*g* further may be tabbed such that pleats 40 which are directed in one direction terminate in a respective tab 48. The two adjacent sections of material 41 may be secured together along the width of the ribbon at a point a short distance from the pleat to form a plurality of tabs 48. The material sections 41 may be secured together by any convenient means such as welding, sewing, gluing or any other suitable means. The length of the tabs 48 may be varied. In this embodiment, the apertures 38*g* are preferably provided through the tabs 48.

While certain present preferred embodiments have been shown and described, it is distinctly understood that the invention is not limited thereto but may be otherwise embodied within the scope of the following claims.

I claim:

1. A cord shroud for use in cooperation with a window covering assembly having a bottomrail and a headrail with a cord lock attached thereto, the window shade assembly having at least two lift cords, each of which are connected at one end to the bottomrail, pass through the headrail and cord lock, have an opposite end accessible to an operator, and an exposed portion which extends from the headrail to the opposite ends when the window shade is open, wherein said lift cords are joined at said opposite ends, the cord shroud comprising:

an elongated, flexible ribbon, the ribbon having a first end connected to the headrail, a second end accessible to the operator, and a plurality of apertures through which the lift cords pass, and of a length sufficient to fit over substantially all of the exposed portion of the lift cords disposed along the length of said ribbon, wherein said lift cords are disposed through and are movable through said plurality of apertures.

2. The cord shroud of claim 1 wherein said ribbon is pleated so as to have a series of transverse pleats provided thereon alternately oriented in opposite directions.

3. The cord shroud of claim 2 wherein said ribbon is made of at least one of fabric, plastic, paper and a combination thereof.

4. The cord shroud of claim 2 further comprising a handle, wherein said end of said ribbon accessible to the operator is connected to said handle, and wherein said ends of said lift cords accessible to the operator are also connected to said handle.

5. The cord shroud of claim 2 wherein said pleated ribbon is tabbed such that each pleat terminates in a respective tab, and wherein said apertures are provided through said tabs.

6. The cord shroud of claim 1, further comprising a plurality of loops spacedly attached to said ribbon of material and wherein said apertures of said ribbon are formed by said plurality of loops.

7. The cord shroud of claim 6 wherein each said loop is shaped and attached to said ribbon in a manner to form at least two apertures.

8. The cord shroud of claim 6 wherein said loops are sections of at least one of fabric and plastic.

9. The cord shroud of claim 6 wherein said ribbon is made of at least one of fabric, plastic, paper and a combination thereof.

10. The cord shroud of claim 6 further comprising a handle, wherein said end of said ribbon accessible to the operator is connected to said handle, and wherein said ends of said lift cords accessible to the operator are also connected to said handle.

11. The cord shroud of claim 1 further comprising a plurality of rings spacedly attached to said ribbon, wherein said plurality of apertures are formed by said rings.

12. The cord shroud of claim 11 wherein each ring is shaped and attached to the ribbon in a manner to form two apertures.

13. The cord shroud of claim 1 wherein said flexible ribbon is a section of material having a plurality of holes spacedly provided through said ribbon, wherein said holes form said apertures.

14. The cord shroud of claim 13 wherein said ribbon is made of at least one of fabric, plastic, paper and a combination thereof.

15. The cord shroud of claim 13 further comprising a handle, wherein said end of said ribbon accessible to an operator is connected to said handle, and wherein said ends of said lift cords accessible to the operator are also connected to said handle.

* * * * *